United States Patent [19]

Howe

[11] 4,275,885

[45] Jun. 30, 1981

[54] TENNIS RACKET

[75] Inventor: John G. Howe, Boulder, Colo.

[73] Assignee: AMF Incorporated, White Plains, N.Y.

[21] Appl. No.: 64,318

[22] Filed: Aug. 6, 1979

[51] Int. Cl.[3] ..... A63B 49/02

[52] U.S. Cl. ..... 273/73 C

[58] Field of Search ..... 273/73 R, 73 C, 73 D, 273/ 73 F, 73 G, 73 H, DIG. 7, 23

[56] References Cited

U.S. PATENT DOCUMENTS

| | | | |
|---|---|---|---|
| 3,690,658 | 9/1972 | Howe | 273/73 F X |
| 3,949,988 | 4/1976 | Staufer | 273/73 F |
| 3,981,504 | 9/1976 | Gugel | 273/73 F |
| 3,999,756 | 12/1976 | Head | 273/73 C |
| 4,045,025 | 8/1977 | Staub et al. | 273/73 F |
| 4,151,995 | 5/1979 | Weed | 273/73 C |
| 4,196,901 | 4/1980 | Durbin | 273/73 G |

FOREIGN PATENT DOCUMENTS

| | | | |
|---|---|---|---|
| 2337851 | 2/1975 | Fed. Rep. of Germany | 273/73 F |
| 2752624 | 5/1979 | Fed. Rep. of Germany | 273/73 C |
| 2717 | of 1909 | United Kingdom | 273/73 D |

*Primary Examiner*—Richard J. Apley

*Attorney, Agent, or Firm*—George W. Price; Walter Lewis

[57] ABSTRACT

The head of the tennis racket has an oblong, oval shape so that the strung ball hitting area has a length to width ratio of about 1.75:1.

1 Claim, 2 Drawing Figures

TENNIS RACKET

Figure 1:
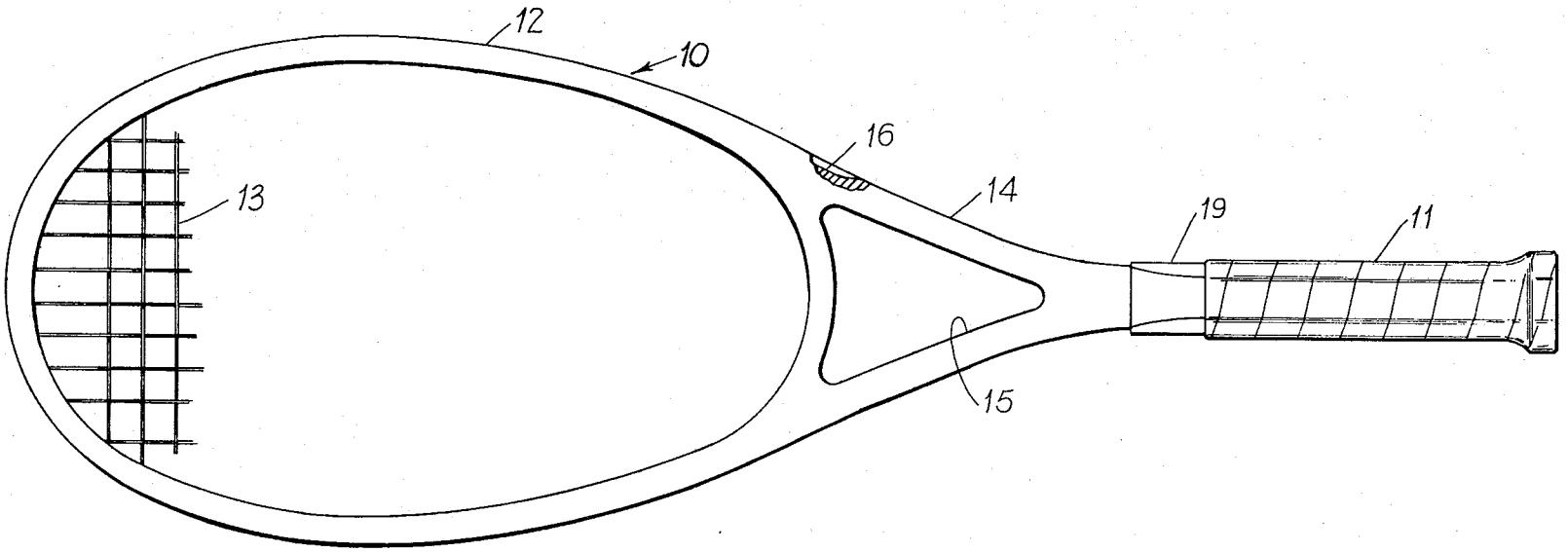

This invention relates to improvements in tennis rackets, and more particularly, to an improved oversized tennis racket.

There are currently on the market several oversized tennis rackets, U.S. Pat. No. 3,999,756 being an example thereof. These oversized tennis rackets provide an increased ball hitting area by making the head of the racket longer and wider than in conventional rackets. I have discovered that other advantages for an oversized racket can be obtained by making the head of the racket oversized in length but comparable to conventional rackets in width.

Briefly, in my invention, the ratio of length to width of the strung area of an oversized racket is of the order of 1.75:1.

In the drawing is shown one embodiment of the invention;

FIG. 1 comprising a face elevation view thereof; and

Figure 2:
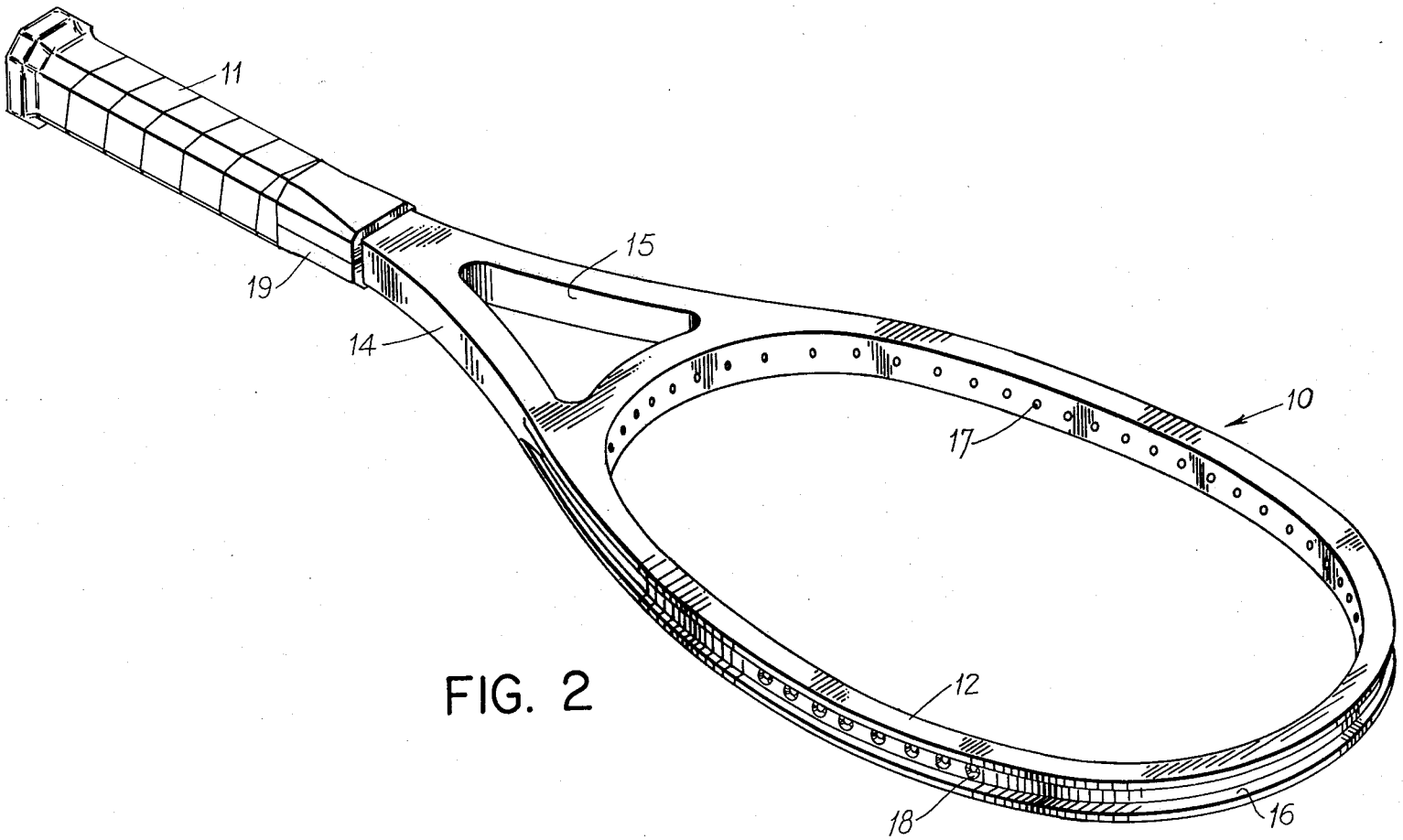

FIG. 2 a perspective view thereof. Opposite sides and edges of the racket are the same. That is to say, the racket is symmetrical. The racket has been shown in reduced scale as an exact replica of a current form of the invention presently on the market under the designation LEGEND, made and sold by the assignee's AMF Head Ski Division of Boulder, Colo.

Briefly, the frame 10 has a hollow or tubular construction of blended graphite-fiberglass composite. The butt or handle end of the frame is provided with a hand grip 11. The ball hitting head part of the frame 12 has an oblong oval shape. Stringing for the head is indicated schematically by crossed lines 13. The opposite ends of the racket are interconnected by an intermediate integral open throat portion 14 having a triangular shaped cutout 15. Thus the head, throat, and handle of the frame comprise a single piece unitary member.

The loop part 12 of the racket is provided with an outer circumferential groove 16 molded therein. Thus, the outer ends of the strings 13 are recessed in the groove 16 to protect them from scuffing. The loop part of the racket has string holes 17 for the strings 13, and the outer ends of the holes 17 can be provided with grommets 18 as illustrated in FIG. 2 so that the outer edges of the holes 17 do not cut the ends of the strings 13. The hand grip 11 comprises leather tape wrapped around two complementary end pieces 19 affixed to the lower butt end of the racket.

In my invention the loop 12 has the shape of an oblong oval. The ratio of the maximum string length to string width in a currently marketed form of the invention is 1.75:1, although this could be slightly more or less. Prior art conventional and oversized rackets have a ratio of much less than 1.75:1. In the currently marketed form of the invention, the strung length is 14" which is slightly longer than the largest of oversized rackets currently on the market, but the strung width is 8" which is comparable to that of conventional rackets and much less than that of the largest of oversized rackets currently on the market. The racket has an overall length of 28" which is about 1" more than that of the current conventional and oversized rackets. Since the loop is an oblong oval, the width thereof along a substantial central portion thereof does not change appreciably. Therefore, a substantial increase in hitting area is obtained while still not making the racket pronouned in width as compared to conventional rackets.

All these features made for several advantages. Since the width is not enlarged, higher string surface tension is obtained along the length of the racket. Although the strings are long lengthwise of the racket, but short crosswise of the racket, the latter contributes to substantial string plane surface tension in the direction of ball hit.

This, and the pronounced increased length of the strung portion relative its width also makes for a longer sweet spot. That is to say, there is a higher and more uniform ball departure velocity over a longer distance of the strung hitting face, and the sweet spot extends further out the end of the racket.

By keeping the oversized hitting area narrow, there is reduced roll inertia about the longitudinal axis of the racket. A high roll inertia makes the racket feel clumsy and more difficult to maneuver.

In summary, the novel ratio of length to width of hitting surface provides the advantages of better control of string tension combined with enlarged hitting area, enlarged sweep spot that is also moved out toward the tip of the racket, and reduced roll inertia.

I claim:

1. A tennis racket comprising a single piece unitary hollow tubular frame constructed from blended graphite-fiberglass composite, said frame comprising a loop portion and a handle portion interconnected by an integral open throat portion, a part of said throat portion comprising a continuation of said loop portion to make said loop portion an enclosed open loop, an outer circumferential stringing groove formed in said loop portion, stringing holes formed in said groove and throat portion part, tennis racket strings extending through said holes lengthwise and crosswise said enclosed open loop, all of said loop, handle and throat portions and said tennis strings being coplanar, said enclosed open loop having an oblong oval shape, said lengthwise strings being about 14" long and said crosswise strings being about 8" long whereby the ratio of the length to the width of the inner strung area of said oblong oval shape is about 1.75 to 1, and said strung area of said oblong oval shape comprising about half of the total length of said racket and said handle and throat portion together comprising the remaining other half of said racket.

* * * * *